US007470851B2

(12) United States Patent
Haga

(10) Patent No.: US 7,470,851 B2
(45) Date of Patent: Dec. 30, 2008

(54) ELECTRONIC STRINGED INSTRUMENT, SYSTEM, AND METHOD WITH NOTE HEIGHT CONTROL

(75) Inventor: Tsuyoshi Haga, Yokohama (JP)

(73) Assignee: Roland Corporation, Hamamatsu (JP)

( * ) Notice: Subject to any disclaimer, the term of this patent is extended or adjusted under 35 U.S.C. 154(b) by 576 days.

(21) Appl. No.: 11/021,663

(22) Filed: Dec. 22, 2004

(65) Prior Publication Data

US 2005/0145103 A1 Jul. 7, 2005

(30) Foreign Application Priority Data

Dec. 26, 2003 (JP) ..... 2003-432107

(51) Int. Cl.
*G10H 1/18* (2006.01)

(52) U.S. Cl. ..... 84/615; 84/616; 84/653; 84/654

(58) Field of Classification Search ..... 84/615, 84/616, 618, 621, 653, 654, 656
See application file for complete search history.

(56) References Cited

U.S. PATENT DOCUMENTS 5,717,155 A * 2/1998 Szalay ..... 84/723

FOREIGN PATENT DOCUMENTS

| | | |
|---|---|---|
| JP | 63-243998 | 10/1988 |
| JP | 01-100596 | 4/1989 |
| JP | 7-110687 | 4/1995 |

OTHER PUBLICATIONS

Japanese Office Action for related Japanese patent application 2003-432107.

* cited by examiner

*Primary Examiner*—David S. Warren
(74) *Attorney, Agent, or Firm*—Foley & Lardner LLP

(57) ABSTRACT

An electronic stringed instrument is provided where the value of a pitch that has been currently detected and the value of a pitch that has been stored are compared. A determination is made as to whether or not the pitch has dropped roughly a half tone. In those cases where the currently detected pitch has dropped roughly a half tone from the pitch detected a specified period earlier, a tone generator begins the attenuation of a musical tone that is generated and the note height of the musical tone is controlled so that the note height does not change.

26 Claims, 7 Drawing Sheets

ELECTRONIC STRINGED INSTRUMENT, SYSTEM, AND METHOD WITH NOTE HEIGHT CONTROL

CROSS-REFERENCE TO RELATED PATENT APPLICATIONS

Japan Priority Application 2003-432107, filed Dec. 26, 2003 including the specification, drawings, claims, and abstract, is incorporated herein by reference in its entirety.

BACKGROUND OF THE INVENTION

1. Field of the Invention

Embodiments of the present invention relate to an electronic stringed instrument and, in particular embodiments, to an electronic stringed instrument in which the pitch and envelope level are detected and the instrument is controlled so as to form a new musical tone that conforms to the pitch and the envelope level.

2. Related Art

In Japanese Laid-Open Patent Application Publication (Kokai) Number Hei 7-110687 (Patent Reference 1) a pitch information detection system is disclosed that detects the vibrations of the strings of an electronic stringed instrument and the like with a pick-up and, using a DSP (digital signal processor), digitally carries out the detection of the pitch. In an electronic stringed instrument such as a guitar synthesizer that has the pitch information detection system that is cited in Patent Reference 1, the tone generator is driven based on the pitch information that has been detected by the pitch information detection system and the envelope level of the string vibrations, and the generation of a new musical tone is carried out in accordance with that.

However, with an electronic stringed instrument that has the pitch information detection system cited in Patent Reference 1, when a specific string is pressed at a fret and the sound is produced, if the finger is released from the fret, the vibration of the string is terminated and the pitch drops slightly at that moment. This is because when the string has been pressed onto the fret, the string vibrates with the fret as the endpoint node but in the instant that the string disengages from the fret when the finger is released from the fret, the finger that is in contact with the string becomes the endpoint node.

Accordingly, an electronic stringed instrument such as that described above detects the fact that the pitch has dropped and the pitch of the musical tone that is produced by the tone generator also is lowered. Because the envelope level suddenly becomes lower when the finger is released from the fret, in those cases only the vibration of the string is emitted as the musical tone, even if there is some degree of a drop in the musical interval, it does not become a problem; but in the case of a guitar synthesizer in which the sound generation is in conformance with the pitch that has been detected, there are instances where the attenuation of the envelope level is dampened after the termination of the musical tone has been instructed and since, when there is a dampened attenuation of the envelope level in a state in which the note height has become low, the vibration of the string is different from the desired pitch, there is a feeling of incompatibility. In particular, when the finger is released in a case such as when the performance is done with chords, since for each string, there is a drop in the pitch that is different for each, there has been a problem in that the harmonization of the chords cannot be done.

SUMMARY OF THE DISCLOSURE

According to a preferred embodiment, the problem discussed above is addressed, and an electronic stringed instrument is provided in which the musical tone of the note height is formed without a feeling of incompatibility even in those cases where the finger has been released from the fret.

Accordingly, an electronic stringed instrument of a first embodiment is one that is furnished with pitch detection means in which the pitch of the string vibration is detected for each specified period of time, and level detection means in which the envelope level of the string vibration is detected, and sound generation start instruction means in which the start of the generation of a musical tone is instructed based on the pitch that has been detected by the pitch detection means and the envelope level that has been detected by the level detection means, and storage means in which the pitches that have been detected by the pitch detection means are stored successively, and sound generation termination instruction means in which the termination of the musical tone, the start of the generation of which has been instructed by the sound generation start instruction means, is instructed based on the envelope level that has been detected by the level detection means, and note height instruction means in which in those cases where when the sound generation termination instruction means instructs the termination of the sound generation, the pitch that has been detected by the pitch detection means is roughly a half tone lower than the pitch that has been detected at a specified time earlier and stored in the storage means, instructs the note height based on the pitch that has been detected at the specified time earlier that is stored in the storage means.

By means of an electronic stringed instrument of the first embodiment, in those cases where the envelope level that has been detected becomes a specified value or lower and a sound generation termination has been instructed, and in those cases where the pitch that has been detected is roughly a half tone lower than the pitch that has been detected at a specified time earlier, the instruction of a note height based on the pitch that has been detected at the specified time earlier is carried out.

An electronic stringed instrument in accordance with a second embodiment is one in which the note height instruction means is one in which the note height is instructed in a scale that is close to the pitch that has been detected prior to a specified time and stored in the storage means.

An electronic stringed instrument in accordance with a third embodiment is furnished with a pitch detection means in which a pitch of string vibrations is detected for each a plurality of specified periods of time, level detection means in which an envelope level of the string vibration is detected for each specified period of time, pitch storage means in which the pitch that has been detected in a previous time period by the pitch detection means is stored, level storage means in which the envelope level that has been detected in the previous time period by the level detection means is stored, and note height instruction means, in which: (1) in those cases where the pitch that has been currently detected by the pitch detection means is about a half tone lower than the pitch that has been stored in the storage means and, moreover, the envelope level that has been currently detected by the level detection means is lower than a first specified value, or (2) in those cases where the pitch that has been currently detected by the pitch detection means is about a half tone lower than the pitch that has been stored in the pitch storage means and, moreover, the difference between the envelope level that has been currently detected by the level detection means and the envelope level that has been stored in the level storage means is greater than a second specified value, the instruction of a note height that corresponds to the pitch that has been currently detected by the pitch detection means is not carried out, and in those cases where the pitch that has currently been detected by the pitch detection means is different from the pitch that has been stored in the pitch storage means and, moreover, cases other than (1) or (2), the instruction of a note height that corresponds to the pitch that has been currently detected by the pitch detection means is carried out.

By means of an electronic stringed instrument of the third embodiment, in those cases where the pitch that has been currently detected is roughly a half tone lower than the pitch that has last been detected and, moreover, the envelope level that has been currently detected is lower than a specified value, or in those cases where the pitch that has been currently detected is roughly a half tone lower than the pitch that has last been detected and, moreover, there has been a sudden attenuation of the envelope level, the instruction of a note height that corresponds to the pitch that has been currently detected is carried out.

An electronic stringed instrument in accordance with a fourth embodiment is one in which the note height instruction means is one in which, in those cases where the instruction of a note height that corresponds to the currently detected pitch is not instructed and in those cases where, at or after a specified period, the pitch that has been detected by the pitch detection means is roughly the same as the pitch that has been currently detected, the instruction of a note height that corresponds to the pitch that has been detected by the pitch detection means is not carried out.

An electronic stringed instrument in accordance with a fifth embodiment is furnished with a pitch detection means in which a pitch of string vibrations is detected for each a plurality of specified periods of time, level detection means in which an envelope level of the string vibration is detected for each specified period of time, pitch storage means in which the pitch that has been detected in a previous time period by the pitch detection means is stored, level storage means in which the envelope level that has been detected in the previous time period by the level detection means is stored, and note height instruction means, in which: in those cases where the pitch that has been currently detected by the pitch detection means has not risen to a specified value above the pitch that has been stored in the pitch storage means, and either (1) the pitch that has been currently detected by the pitch detection means is about a half tone lower than the pitch that has been stored in the pitch storage means and, moreover, the envelope level that has been currently detected by the level detection means is lower than a first specified value, or (2) the pitch that has been currently detected by the pitch detection means is about a half tone lower than the pitch that has been stored in the pitch storage means and, moreover, the difference between the envelope level that has been currently detected by the level detection means and the envelope level that has been stored in the level storage means is greater than a second specified value, the instruction of a note height that corresponds to the pitch that has been currently detected by the pitch detection means is not carried out, and in those cases where the pitch that has been currently detected by the pitch detection means has not risen to the specified value above the pitch that has been stored in the pitch storage means and the pitch that has currently been detected by the pitch detection means is different from the pitch that has been stored in the pitch storage means and, moreover, cases other than (1) or (2), the instruction of a note height that corresponds to the pitch that has been currently detected by the pitch detection means is carried out, and wherein, in those cases where the pitch that has been currently detected by the pitch detection means has risen to the specified value above the pitch that has been stored in the pitch storage means, a note height instruction for a note height that corresponds to the pitch that has been detected at that time or later is carried out.

By means of an electronic stringed instrument of the fifth embodiment, in those cases where the pitch that has been currently detected rises to a specified value above the pitch that has last been detected and in those cases where the pitch has been changed at that time or later, the instruction of a note height that corresponds to the pitch that has been changed is instructed but in those cases where the pitch that has been detected has not risen to the specified value or above, and in those cases where the pitch that has been currently detected is roughly a half tone lower than the pitch that has last been detected and, moreover, the envelope level that has been currently detected is lower than a specified value, or in those cases where the pitch that has been currently detected is roughly a half tone lower than the pitch that has last been detected and, moreover there is a sudden attenuation of the envelope level, the instruction of a note height that corresponds to the pitch that has been currently detected is not carried out.

An electronic stringed instrument in accordance with a sixth embodiment is one in which the note height means is one in which, in those cases where the period in which the instruction of a note height that corresponds to the pitch that has been currently detected is not carried out has exceeded a specified period, the instruction of a note height that corresponds to the pitch that has been currently detected by the pitch detection means is carried out at that time or later.

In accordance with an electronic stringed instrument of the first embodiment, since in those cases where the envelope level of the string vibrations of the stringed instrument becomes low and a sound generation termination has been instructed, and in those cases where the pitch has dropped roughly a half tone, a note height that corresponds to the pitch that has been detected at a specified time earlier that is stored in the storage means is instructed, there is the advantageous result that even if the pitch of the vibration of the string drops due to the fact that the finger is released from the fret of the stringed instrument, it is possible to prevent the dropping of note height of the musical tone that is produced.

In accordance with an electronic stringed instrument of the second embodiment, in addition to the advantageous result that is exhibited by the electronic stringed instrument of the first embodiment, since the note height that is instructed is a note height of the scale that is close to the pitch that has been stored in the storage means, there is the advantageous result that a musical tone of that scale is generated. In particular, in those cases where a plurality of musical tones are formed based on the vibrations of a plurality of strings such as the case in which a chord has been performed, there is the advantageous result that the harmonization of the chord is maintained.

In accordance with an electronic stringed instrument of the third embodiment, since in those cases where the pitch of the string vibration drops roughly a half tone and the envelope level is at a specified level or below or the attenuation of the envelope level is at a specified value or above, the instruction of a note height in conformance with the pitch that has been detected is not carried out, there is the advantageous result that even if the pitch that has been detected drops, due to the fact that the finger is released from the fret of the stringed instrument, it is possible to prevent the dropping of the note height of the musical tone that is generated.

In accordance with an electronic stringed instrument of the fourth embodiment, in addition to the advantageous result that is exhibited by the electronic stringed instrument of the third embodiment, since in those cases where the pitch that has been detected has dropped roughly a half tone, if the instruction of a note height that corresponds to the pitch that has dropped is not carried out and the pitch that has been detected is roughly the same pitch that continues for a specified period, the instruction of the note height is not carried out, there is the advantageous result that in those cases where the pitch that has been detected had dropped due to the fact that the finger has been released from the fret, it is possible to prevent the dropping of the note height in a specified period. In addition, by the setting of the specified period to the period until the vibrations of the string nearly stop, there is the advantageous result that it is possible to instruct the termination of the musical tone in the tone generator without instructing a note height that has dropped because the finger has been released from the fret.

In accordance with an electronic stringed instrument of the fifth embodiment, since in those cases where the pitch that has been detected has risen to a specified value or above, even if the pitch drops after that, the instruction of a note height that corresponds to the pitch that has been detected is carried out, there is the advantageous result that in those cases where the performer has intentionally raised the pitch to a specified value or above, the change in the pitch is faithfully reflected in the musical tone and it is possible to prevent a determination that there is an erroneous release of the finger.

On the other hand, in those cases where the pitch of the string vibration drops roughly a half tone without there being a rise in the pitch that has been detected to a specified value or above, and the envelope level is at a specified value or below or the attenuation of the envelope level is at a specified value or above, since the instruction of a note height in conformance with the pitch that has been detected is not carried out, there is the advantageous result that even if the pitch that has been detected drops due to the fact -that the finger has been released from the fret of the stringed instrument, it is possible to prevent the dropping of the note height of the musical tone that is produced.

In accordance with an electronic stringed instrument of the sixth embodiment, in addition to the advantageous result that is exhibited by the electronic stringed instrument of the fifth embodiment, since in those cases where the period in which the instruction of a note height is not carried out has exceeded a specified period, the instruction of a note height is carried out at that time or later, there is the advantageous result that even in those cases where a performance such as a trill and the like has been carried out without releasing the finger, it is possible to have the note height change of the tone generator comply with the note height change in accordance with the performance after a specified period.

DETAILED DESCRIPTION OF PREFERRED EMBODIMENTS

Figure 1:
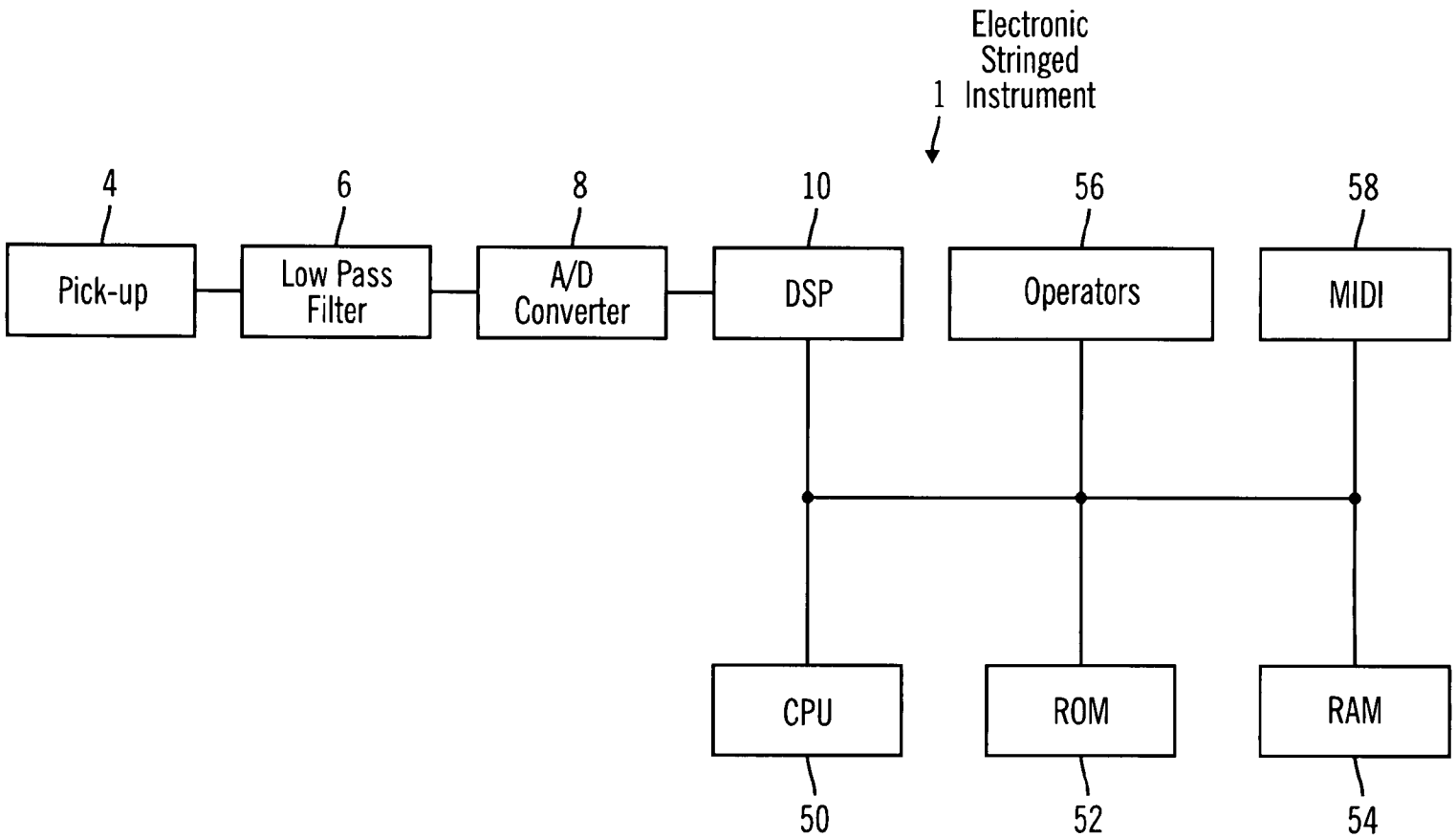
FIG. 1 is a block diagram that shows a configuration of an electronic stringed instrument 1 of an embodiment of the invention.

Explanations will be given below regarding preferred embodiments while referring to the attached drawings. FIG. 1 is a block diagram that shows a configuration of an electronic stringed instrument 1 of a preferred embodiment.

As is shown in FIG. 1, the vibrations of the string that have been detected by the pick-up 4 are supplied to the analog to digital (A/D) converter 8 via a low pass filter (LPF) 6 used for antialiasing. The A/D converter digitizes the string vibrations at a specified sampling frequency (for example, 32 KHz) and supplies them as a digital string signal to the DSP 10. Incidentally, in FIG. 1, the pick-up 4, the LPF 6, and the A/D converter 8 are shown but, in reality, these are each disposed for all of the strings of the electronic stringed instrument and the signals of each of the strings that have been digitized are respectively supplied to the DSP 10. The DSP 10 detects the pitch and envelope level for each string and supplies these detection values to the CPU 50.

The detected values are input to the CPU 50, which carries out prescribed processing and outputs the MIDI messages such as Note On, Note Off, bend, and the like via the MIDI interface 58. These MIDI messages are input to a tone generator that is not shown in the drawing, which generates the musical tones that correspond to the messages.

The ROM 52 is something in which the programs that are executed by the CPU 50, the tables that show the correspondence relationships between the pitch that have been detected and the musical scale, the fixed values and the like are stored. The RAM 54 is a writable memory that is employed as the working area that is used at the time that the programs are executed by the CPU 50, stores the various types of flags that will be discussed later, and is used as a ring buffer.

The operators 56 are something with which the various types of parameters are set by the performer and are furnished with a volume control that sets the volume, a switch that selects the timbre, and the like, and the CPU 50 controls the parameters of the MIDI messages that are sent to the tone generator by reading the setting state of these operators.

In the following illustration, the explanation will be given regarding the digital string signal that is obtained from one string but the same processing is carried out independently for each of the other strings.

Figure 2:
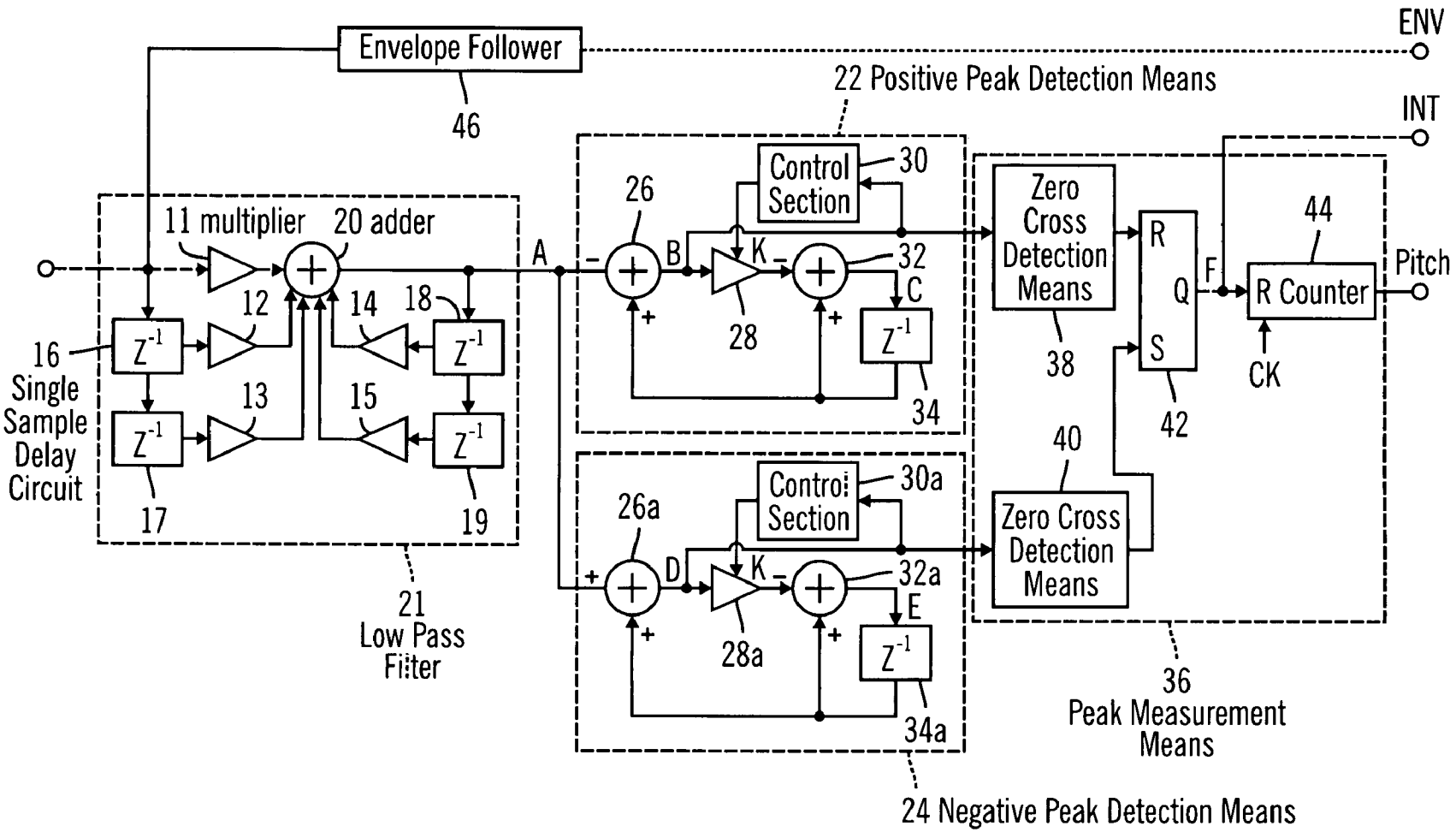
FIG. 2 is a schematic diagram of processing functions of a DSP.
Figure 3:
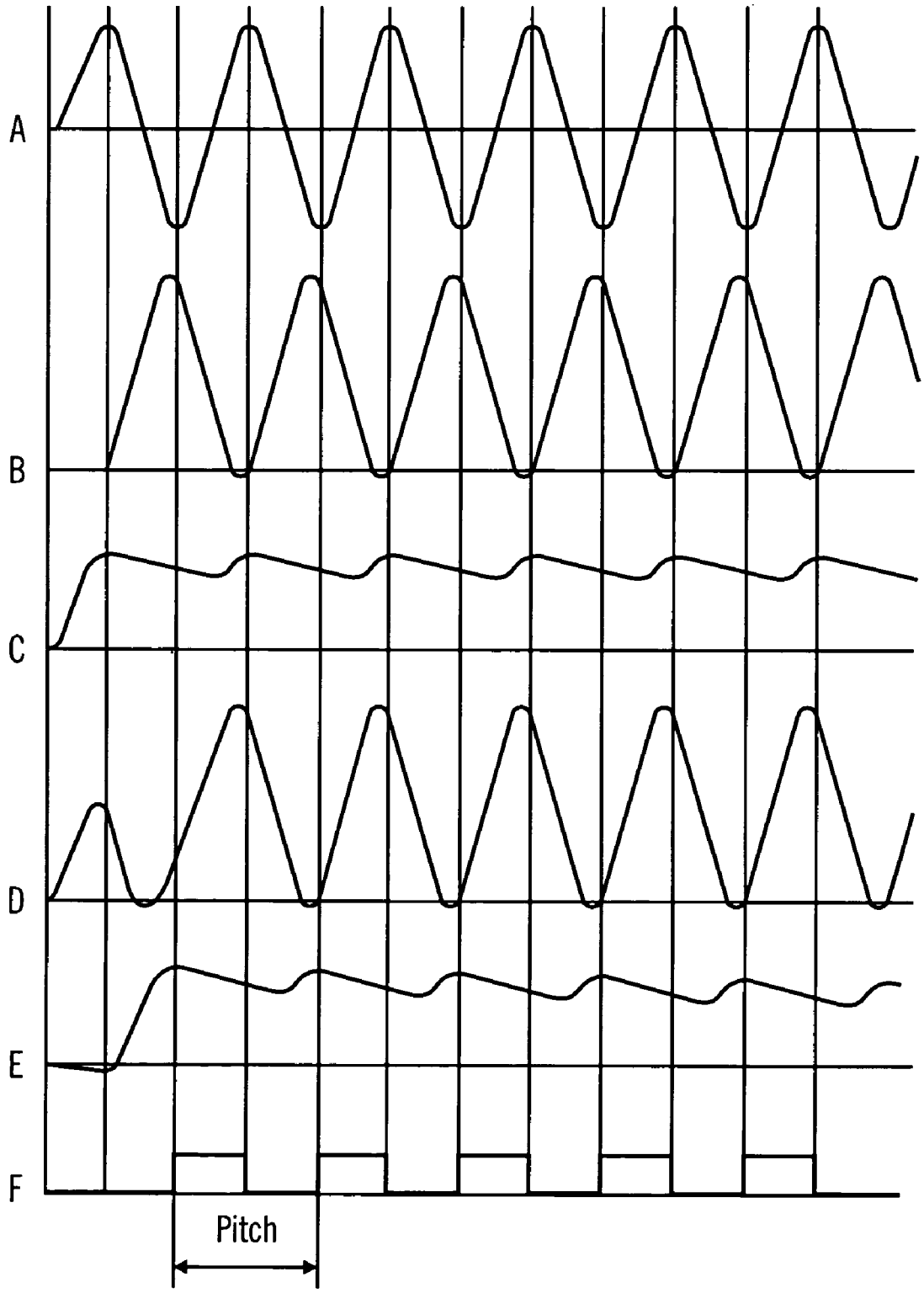
FIG. 3 is a graph that shows waveforms of each section that have been processed in the DSP.

FIG. 2 is a drawing for the explanation of the processing functions of the DSP 10 and provides an explanation while making a comparison with the waveforms of each section of the DSP shown in FIG. 3. The digital string signal that has been supplied from the A/D converter 8 is supplied to the low pass filter 21 that is configured by the multipliers 11, 12, 13, 14, and 15, the single sample delay circuits 16, 17, 18 and 19, and the adder 20. The low pass filter 21 is disposed in order to form a waveform from the digital string signal. The output signal of the low pass filter 21 is supplied to the positive peak detection means 22 and the negative peak detection means 24. The positive peak detection means 22 has an adder 26, and the output signal of the low pass filter 21 is supplied to the subtraction input terminal of the adder 26. The output signal of the adder 26 is multiplied by the proportional constant K using the multiplier 28. The proportional constant ($0<K<1$) is supplied from the control section 30. The control section 30 supplies a large value for K (for example, 0.99) to the multiplier 28 when the output signal of the adder 26 is negative and supplies a small value for K (for example, 0.01) to the multiplier 28 when the output signal of the adder 26 is positive.

The output signal of the multiplier 28 is supplied to the subtraction input terminal of the adder 32, the output signal of the adder 32 is supplied to the single sample delay circuit 34 (the delay circuit 34), and the output signal of the delay circuit 34 is supplied to the addition input terminal of the adder 32. In addition, the output signal of the delay circuit 34 is also supplied to the addition input terminal of the adder 26. Accordingly, the adders 26 and 32, the multiplier 28, and the delay circuit 34 configure a recursive type digital filter.

In the peak detection means 22, if the value of K is near 0, the output of the adder 26 becomes a value that is close to the difference between the input value and the integral value up to that point (the integral value up to the current sample) and if the value of K is near 1, the output of the adder 26 becomes a value that is close to the difference between the input value and the value of one sample before.

As a representative example, since in those cases where a sine wave signal such as is shown in FIG. 3A has been input to the adder 26 from the low pass filter 2 1, at first the output of the delay circuit 34 is initially 0, the output of the adder 26 becomes a value in which the input sine wave has been subtracted from 0 and this becomes negative as is shown in FIG. 3B. Accordingly, the value of K becomes large, for example, a value close to 1. Because of this, the integration action of the integration circuit becomes low and, as is shown in FIG. 3C, as the value of the sine wave becomes larger, the output of the adder 32 also becomes large. The output of the adder 26, in which the input sine wave has been subtracted from the signal of the output of the adder 32 that has been delayed one sample by the delay circuit 34, is maintained at a negative value until the positive peak of the input sine wave is reached.

When the positive peak of the input sine wave is reached and, following that, the value of the input sine wave becomes smaller, the output signal of the adder 26 changes from negative to positive and the value of K becomes a value that is close to 0. Because of this, the integration action of the integration circuit increases and the output signal of the adder 32, as is shown in FIG. 3B, gradually moves toward a value that is smaller from the value that was integrated up to the positive peak value of the input sine wave. This is because the value of K never is perfectly 1. During this time, since the input sine wave (in which the value continues to decrease from the positive peak) is subtracted from the delayed output by the delay circuit 34 of the output of the adder 32 (a positive value) by the adder 26, the output of the adder 26 is maintained at a positive value.

Then, when the negative peak of the input sine wave is passed and there is a shift to an increase, the output of the adder 26 is also a positive value but a drop begins and around the time that the input sine wave has changed from negative to positive, the output of the adder 26 becomes a negative value. Because of this, the value of K becomes a value that is close to 1, the integration function of the integration circuit becomes smaller, and the output of the adder 32 tracks the input sine wave and increases. During this time, the output of the adder 26 maintains a negative value and, when the input sine wave reaches the positive peak, the output of the adder 26 changes from negative to positive.

Below, since the operation is the same, the positive peak of the input sine wave corresponds to the transition point from negative to positive (the zero cross point) of the output of the adder 26.

In addition, the peak detection means 24 is configured virtually the same as the peak detection means 22. Those areas that are equivalent have been assigned a key having an "a" on the end of the identical code and the explanations of these will be omitted. However, it should be noted that with the peak detection means 22, the digital string signal is supplied to the subtraction input terminal of the adder 26 and the output signal of the delay circuit 34 is supplied to the addition terminal. In contrast to this, with the peak detection means 24, there is a difference in that the output signal of the delay circuit 34*a* and the digital string signal are supplied to the two addition input terminals of the adder 26*a*. This is in order to detect the negative peak of the output signal of the low pass filter 21.

Incidentally, for reference, the output of the adder 26*a* is shown in FIG. 3D and the output of the adder 32*a* is shown in FIG. 3E. From FIG. 3D and FIG. 3E also, the fact that the transition point (the zero cross point) from negative to positive of the output of the adder 26*a* corresponds to the peak of the input signal can be ascertained.

The output signals of these peak detection means 22 and 24 are supplied to the peak measurement means 36. The peak measurement means 36 has the zero cross detection means 38 and 40 (the zero crosses 38 and 40). The zero cross detection means 38 receives the output signal from the peak detection means 22 and, when this is the zero cross in which there is a change from negative to positive, generates an output signal.

The output signal of the zero cross detection means 38 is supplied to the R input terminal of the SR flip-flop 42 and the output signal of the zero cross detection means 40 is supplied to the S input terminal of the SR flip-flop 42. Accordingly, the Q output terminal of the SR flip-flop, as is shown in FIG. 3F, generates an output signal during the time until the negative peak of the output signal of the low pass filter 21 turns toward a positive peak.

The output signal of the SR flip-flop 42 is supplied to the counting means 44 (the counter 44). The counting means 44 counts the number of samples of the high period and the low period for the Q output terminal of the SR flip-flop 42. It is possible to detect the pitch of the vibrations of the string by means of the count value. However, it should be noted that since the sample count only has the resolution that is in accordance with the sampling frequency, there are cases where the accuracy of the pitch detection is not sufficient. In a case such as this, interpolation is performed between samples in order to carry out a zero cross detection such as that described above. The pitch that has been detected is supplied to the CPU 50 from the PITCH output via the bus and the output signal F of the SR flip-flop 42 is supplied as the interrupt signal INT to the CPU 50.

On the other hand, the digital string signal that has been supplied from the A/D converter is input to the envelope follower 46 and the envelope level is detected. The envelope follower 46 rectifies the digital string signal that has been provided and carries out integration again. The envelope level that has been detected is supplied to the CPU 50 from the ENV output via the bus.

Figure 4A:
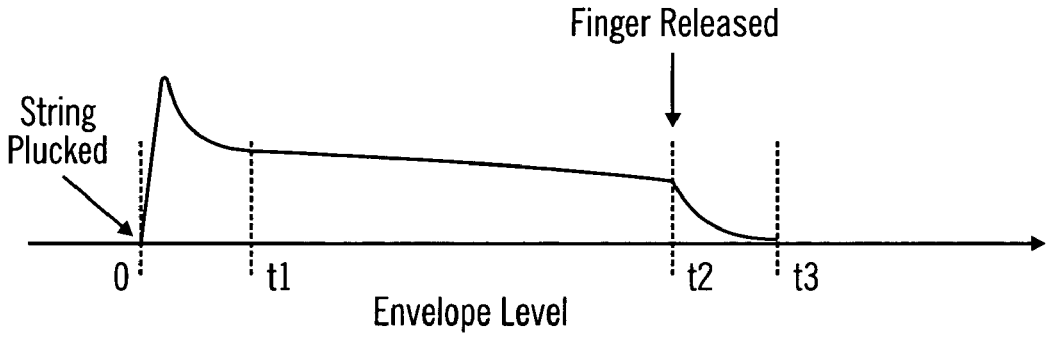
FIG. 4A is a graph that shows changes in envelope level of string vibrations.
Figure 4B:
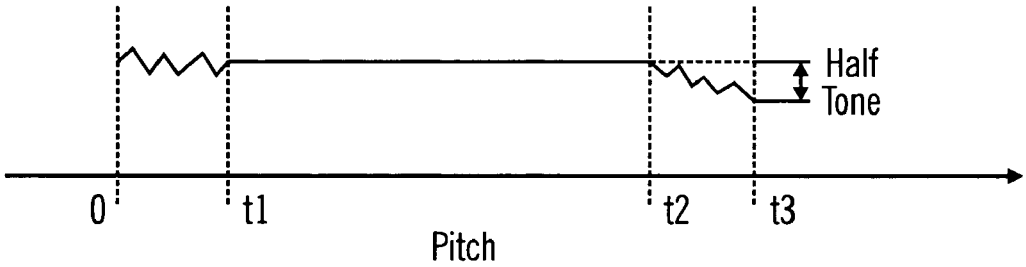
FIG. 4B is a graph that shows changes in pitch of string vibrations.

Next, an explanation will be given regarding the change in the pitch and the envelope level of the string vibration in a stringed instrument that has frets while referring to FIG. 4. FIG. 4 shows a comparison of the conditions of the changes in the envelope level (a) and the pitch (b) using the same time axis following the passage of time when a specified string that is in a state in which the string is pressed on a fret is plucked and the vibration begins until the sound is dampened because the finger is released from the fret (hereafter, referred to as "finger releasing"). When the string is plucked at the time 0, the envelope level (a) rapidly increases and when the maximum level is reached, begins to attenuate. On the other hand, the pitch (b) fluctuates during the period from the time 0 to the time t1. When the time t1 is passed, the envelope level begins to slowly attenuate and the pitch is maintained at a fixed value. When the finger that has been pressing on a specified fret is released at the time t2, a drop in the pitch starts and following that, the envelope level begins to rapidly attenuate. When the time t3 is reached, the envelope level becomes nearly level 0 (zero) and the pitch drops about a half tone.

However, although there are cases where, due to a typical finger releasing such as that described above, there is a drop in the pitch of roughly a half tone, there are various kinds of cases due to such other factors as the speed at which the finger is released from the fret, the size of the amplitude of the vibration of the string at that time, or the thickness of the string, and the like. In comparison, there are also cases where, in a state in which the envelope level is great, the pitch drops roughly a half tone and the envelope level also attenuates.

Preferred embodiments of the present invention focus on this kind of string behavior and even when the pitch drops at the time that the finger is released from the fret, based on the changes in the envelope level and the pitch, the musical tone that is generated by the tone generator is controlled such that a musical tone having a note height that does not give a feeling of incompatibility is formed. An explanation will be given below regarding the processing that is carried out by the CPU 50 while referring to the flowcharts.

Figure 5:
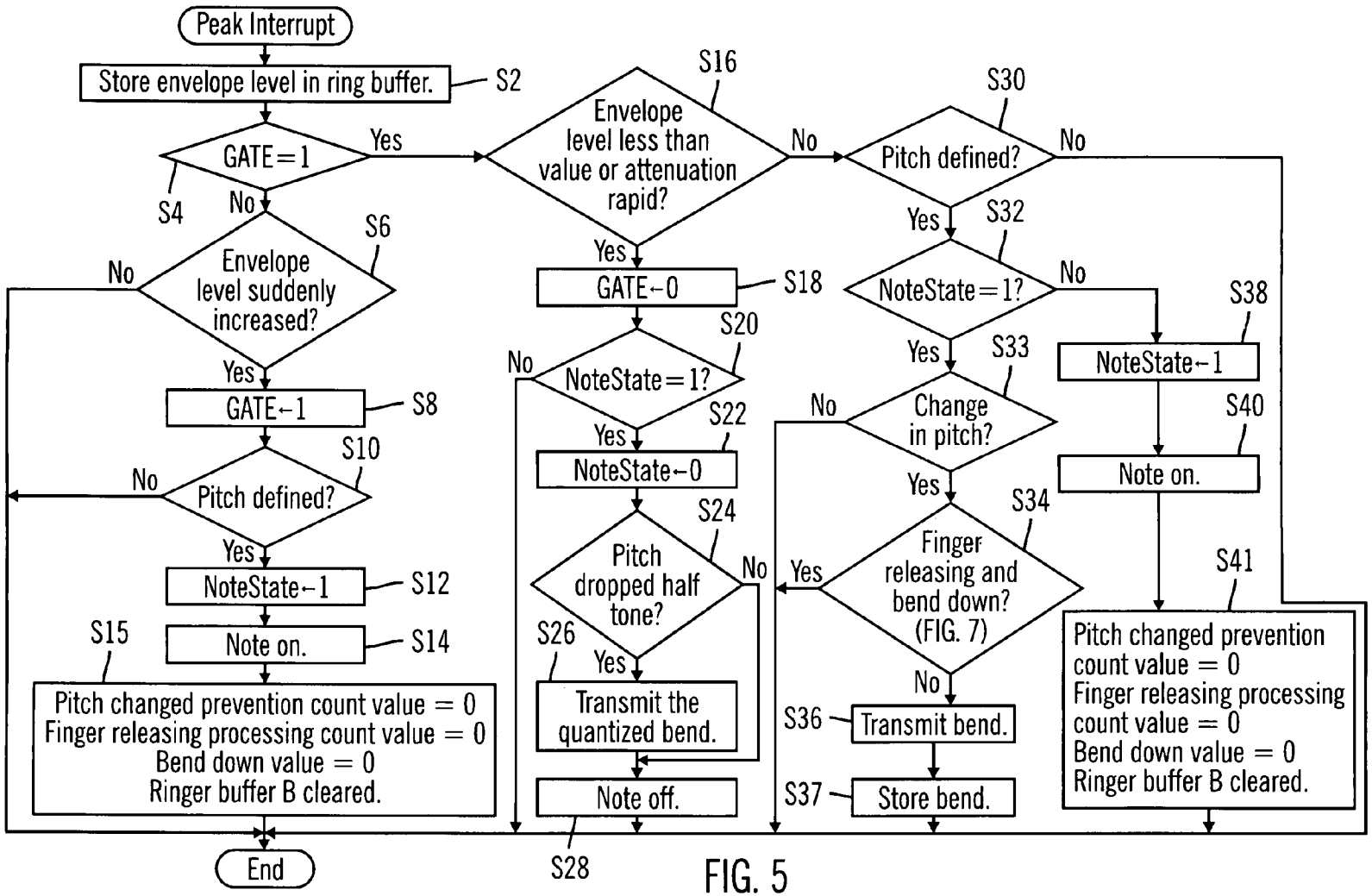
FIG. 5 is a flowchart that shows an interrupt routine of a CPU.

FIG. 5 is a flowchart that shows the interrupt routine that is launched by the output signal of the SR flip-flop 42 of the DSP 10. The main routine, which is launched by turning on the power to the electronic stringed instrument, is not shown in the drawing but by means of the main routine, the parameters that have been set by the operators 56 are read out and processing such as settings in order to receive the interrupt routine that is explained here and the like are carried out. Since the main routine is not essential to embodiments of the present invention, the explanation will be omitted.

With the interrupt processing, first, the envelope level that is supplied by the envelope follower 46 is stored in the ring buffer A (S2). The ring buffer A stores several tens of envelope level values that have been detected and a storage region is established within the RAM 54.

Next, a determination is made as to whether or not the GATE, which is a flag, is set to "1" (S4). In those cases where the flag GATE is not "1" (S4: no), the ring buffer A is examined and a determination is made as to whether or not the envelope level has suddenly increased (S6). In those cases where it is determined that the envelope level has suddenly increased (S6: yes), the flag GATE is set to "1" (S8) and a determination is made as to whether or not the pitch has been defined (S10). The processing in which a determination is made as to whether or not the pitch has been defined is one in which a determination is made as to whether or not the value counted by the counting means 44 is such that a value that is stable is supplied and since this is not essential to the present invention, a detailed explanation will be omitted.

In those cases where it has been determined that the pitch has been defined (S10: yes), the Note State, which is a flag is set to "1" (S12), the musical scale that corresponds to the pitch that has been defined (the note number) and the velocity value that corresponds to the envelope level are obtained and a Note On message that includes these parameters is output from the MIDI interface 58 (S14). The musical scale that corresponds to the defined pitch is obtained by being read out from a table that expresses the relationship between the pitch and the musical scale, which is stored in the ROM 52. In addition, when the pitch has been defined, since the envelope level has already reached a maximum value, the velocity value is determined based on the maximum value from among the envelope level values that are stored in the ring buffer A. Since this processing is, as is shown in FIG. 4, carried out approximately at the time t1, the pitch is unstable but it is preferable that it be defined as early as possible.

Next, the pitch change prevention count value, the finger releasing processing count value, and the bend down value are set to "0" and the ring buffer B is cleared (S15). The pitch change prevention count value, the finger releasing processing count value, the bend down value, and the ring buffer B will be discussed later.

Incidentally, in those cases where, in the processing of S6, a determination that the envelope level has suddenly increased has not been made (S6: no) and in those cases where, in the processing of S10, a determination has been made that the pitch has not been defined (S10: no), the routine ends.

In those cases where, in the processing of S4, a determination has been made that the flag GATE is set to "1" (S4: yes), the ring buffer A is examined and a determination is made as to whether or not the envelope level has become less than a specified threshold value A or, even if the envelope level is greater than the threshold value A, the attenuation is rapid (S16). In those cases where a determination is made that the envelope level has become less than the threshold value A or that the envelope level is greater than the threshold value A but the attenuation is rapid (S16: yes), the flag GATE is set to "0" (S18).

Next, a determination is made as to whether or not the flag Note State is set to "1" (S20). In those cases where a determination has been made that the flag Note State is not set to "1" (S20: no), the routine ends. This is because it is a case in which the envelope has suddenly increased once and has already decreased and noise and the like have been input.

On the other hand, in those cases where, in the processing of S20, a determination has been made that the flag Note State is set to "1" (S20: yes), the flag Note State is set to "0" (S22), the value of the pitch that has been currently detected and the value of the pitch that has been stored in the ring buffer B are compared, and a determination is made as to whether or not the pitch has dropped roughly a half tone (S24). The ring buffer B is something that is a storage region that is set within the RAM 54 and has been stored as bend information that has been transmitted in the processing of S37 that will be discussed later. In addition, what is compared is the value of the pitch that corresponds to the value of the bend information that has been detected a specified cycle earlier, which is stored in the ring buffer B, and with regard to the drop of roughly a half tone, this is a drop in a range of from a pitch that is 70 cents below to a pitch that is 130 cents below the value of the pitch. Incidentally, 100 cents is a half tone.

In those cases where, in this determination, the pitch that has been currently detected has been determined to have dropped roughly a half tone (S24: yes), quantization is done in accordance with the read-out the note height of the musical scale that is the closest to the pitch that has been detected the specified period earlier from a table that expresses the relationship between the pitch and the musical scale which is stored in the ROM 52, and the bend information that corresponds to the note height is transmitted (S26). Next, the Note Off information of the note that is the same as the note for which the Note On information has been included (S28) is transmitted. This processing is processing that is carried out at a time that is slightly after the time t2 in FIG. 4. Because of this, the tone generator begins the attenuation of the musical tone that is generated and, together with this, the note height of the musical tone is set to the note height of the musical scale that has been instructed by the bend information. Incidentally, the bend information expresses the difference between the pitch of the musical scale that indicates the note that is included in the Note On information and the pitch that it is actually desired to generate.

In those cases where, in the processing of S24, a determination that the pitch that has been currently detected has dropped roughly a half tone has not been made (S24: no) processing in which the Note Off information is transmitted for the note that is the same as the note for which the Note On of S28 has be transmitted is carried out and the processing ends.

On the other hand, in those cases where, in the processing of S16, a determination has been made that the envelope level is greater than the threshold value A and, moreover, the attenuation is not rapid (S16: no), a determination is made as to whether or not the pitch has been defined (S30). In those cases where a determination has been made that the pitch is not defined (S30: no), the processing ends without doing anything; and in those cases where a determination has been made that the pitch has been defined (S30: yes), a determination is made as to whether or not the flag Note State is "1" (S32). In those cases where the flag Note State is not "1" (S32: no), since this means that the envelope level has suddenly increased but the pitch has not yet been defined, the flag Note State is set to "1" (S38), the scale (the note number) that corresponds to the pitch that has been defined and the velocity value that corresponds to the envelope level are obtained, and the Note On message that includes these parameters is output from the MIDI interface 58 (S40). Next, the pitch change prevention count value, the finger releasing processing count value, and the bend down value are set to "0" and the ring buffer B is cleared (S41). The pitch change prevention count value, the finger releasing processing count value, the bend down value, and the ring buffer B will be discussed later.

In those cases where, in the processing of S32, a determination has been made that the Note State is "1" (S32: yes), the pitch that has been currently detected and the pitch that has previously been detected (stored in the ring buffer B) are compared and a determination is made as to whether or not there has been a change (S33). In those cases where a determination has been made that the pitch has not changed (S33: no), the processing ends; and in those cases where a determination has been made that the pitch has changed (S33: yes), a determination is made as to whether or not there is a finger releasing and a bend down (S34). With regard to this determination processing, the details will be discussed later while referring to the flowcharts of FIG. 6 and FIG. 7. In those cases where, in this determination processing, a determination has been made that there is a finger releasing and a bend down (S34: yes) the processing ends; and in those cases where a determination has been made that there is not a finger releasing and a bend down (S34: no), the bend information that corresponds to the pitch that has been currently detected is transmitted to the tone generator (S36), the bend information is stored in the ring buffer B that has been disposed in the RAM 54 (S37) and the processing ends. Since the bend information that has been transmitted is stored in the ring buffer B in the same manner as in the ring buffer A, a region is maintained that stores several tens of bend information items.

Figure 6:
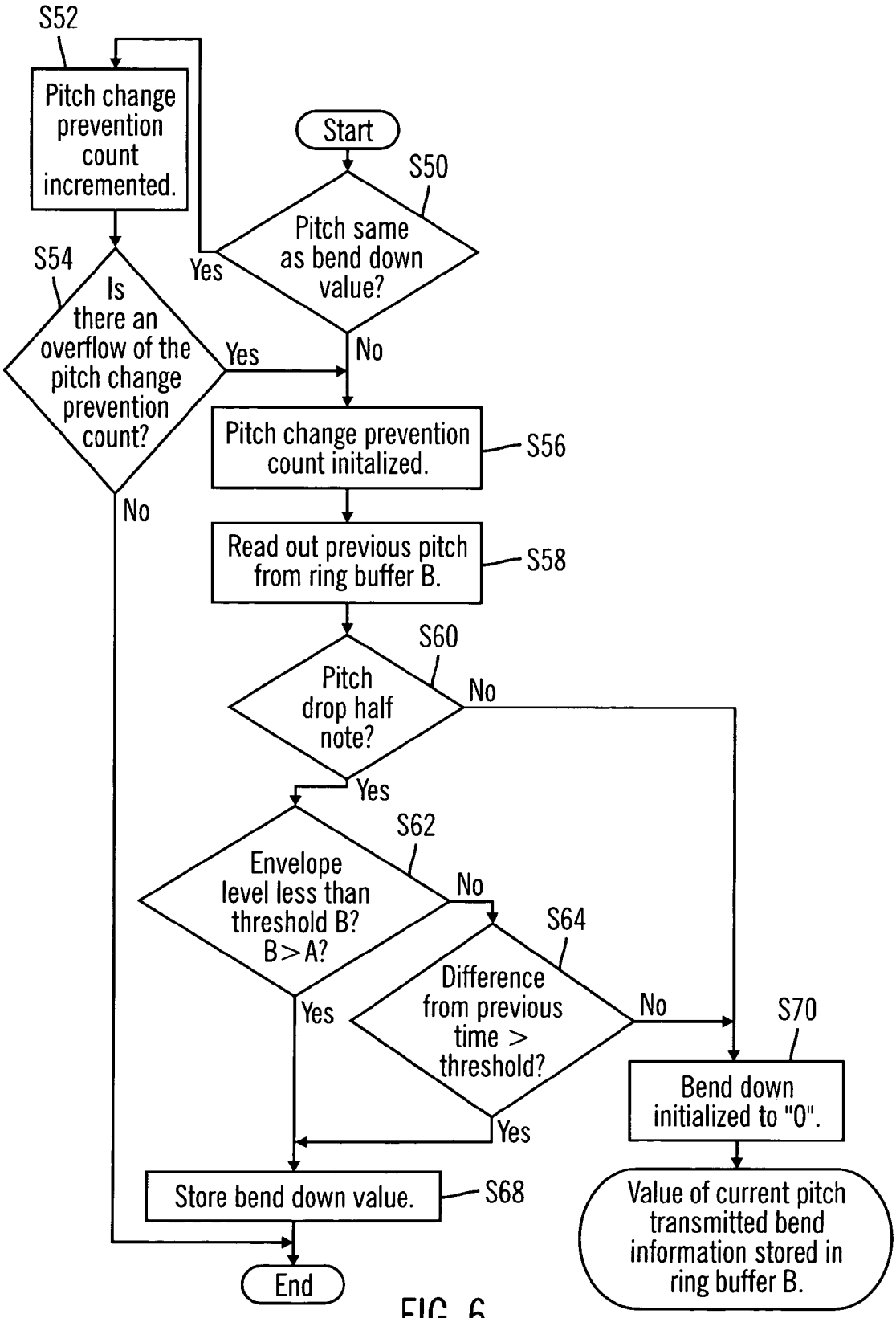
FIG. 6 is a flowchart that is a detail of the flowchart shown in FIG. 5 according to a first preferred embodiment.

The flow chart that is cited in FIG. 6 is a first preferred embodiment of the processing of S34 described above, and the flowchart that is cited in FIG. 7 shows a second preferred embodiment of the processing of S34 described above. In these processes, a determination is made as to whether the cause of the change in the pitch is based on various conditions that are due to the fact that the finger has been released from the fret, or due to the fact that the vibrato or the tremolo arm has been operated; and in those cases where a determination has been made that the finger has been released from the fret, the note height is controlled so that there is no change, and in those cases where a determination has been made that the finger has not been released, the note height is controlled to track the pitch that has changed.

First, an explanation will be given regarding a first preferred embodiment that is depicted in FIG. 6. A determination is made as to whether or not the pitch that has been currently detected is roughly the same as the pitch that corresponds to the bend down value (S50). The bend down value is something that is stored in the RAM 54 and, as discussed before, has been initialized when the Note On information was transmitted to the tone generator and is a value that is updated and stored by the processing of S68 that will be discussed later. Next, the pitch change prevention count is initialized (set to "0"). The value of the pitch change prevention count is also something that is stored in the RAM 54.

In those cases where, in the determination processing of S50, a determination has been made that the pitch that has been currently detected is not roughly the same as the bend down value (S50: no), the pitch change prevention count is initialized (S56); following that, the bend information that has been transmitted the previous time is read out from the ring buffer B (S58) and a determination is made as to whether or not the pitch that has been currently detected has dropped roughly a half tone from the pitch that corresponds to the bend information (S60). With regard to the drop of roughly a half tone, this is a drop in a range from a pitch that is 70 cents lower than the pitch that corresponds to the bend information to a pitch that is 130 cents lower than the pitch that corresponds to the bend information.

In those cases where the pitch that has been currently detected is one that has dropped roughly a half tone from the pitch that corresponds to the bend information (S60: yes), a determination is made as to whether or not the envelope level that has been currently detected is less than a specified threshold value B (S62). Incidentally, the threshold value B is an envelope level value that is greater than the threshold value A. In those cases where the envelope level that has been currently detected is less than the threshold value B (S62: yes) or in those cases where the envelope level that has been currently detected is greater than the threshold value B (S62: no) and in the case where the difference from the envelope level that was detected the previous time is greater than a specified threshold value (S64: yes), the bend information that corresponds to the pitch that has been currently detected is stored as the bend down value (S68). In other words, in those cases where the pitch that has been currently detected is one that has dropped from the pitch of the previous time, the difference is less than a specified threshold value, and the envelope level that has been currently detected is less than the threshold value B or the attenuation of the envelope level that has been currently detected is great, the bend value that corresponds to the value of that pitch is stored as the bend down value and the instruction of a note height is not carried out in the tone generator. Accordingly, it is set up such that even if the pitch that has been detected drops, the pitch of the musical tone that is generated by the tone generator does not drop.

On the other hand, in those cases where, in the determination processing of S50, a determination has been made that the current pitch is roughly the same as the pitch that has been stored as the bend down value (S50: yes), the pitch change prevention count is incremented (S52) and a determination is made as to whether or not there has been an overflow by the value that has been incremented (S54). In those cases where there has been a overflow (S54: yes), the routine advances to S56 and in those cases where there has not been an overflow (S54: no), it is presumed that there is a finger releasing and a bend down and the routine ends. In this processing, after the pitch that has been detected has dropped once, if the pitch is stable, it is concluded that the pitch that has been detected has dropped due to a finger releasing during that period and the instruction of a note height that corresponds to the pitch that has been detected is not carried out. Accordingly, the pitch of the musical tone that is generated by the tone generator does not drop. However, in those cases where this period exceeds the period that is counted by the pitch change prevention count, the pitch that has been detected again is compared with the previous pitch that has been stored in the ring buffer B. If the reason that the pitch has dropped is a finger releasing, since the envelope level has rapidly attenuated during the period, the determination of S16 of the flowchart that is shown in FIG. 5 at the point in time of the attenuation becomes "yes" and the Note Off processing is carried out. The pitch of the musical tone that is generated by the tone generator is instructed to the note height of the musical scale.

On the other hand, in those cases where it is not a finger releasing and a performance such as a trill or a vibrato and the like has been carried out, the pitch of the tone generator is controlled so as to track the pitch that has been detected again. Here, what is meant by a trill performance is a performance in which a finger is quickly pressed on (hammering on) and released from (pulling off) the fret that is next to the fret that is being pressed and vibrato is a performance in which the string is pressed down and pushed up on the fret that is being pressed.

In those cases where, in the determination processing of S60, the pitch that has been currently detected is not one that has dropped roughly a half tone from the pitch that corresponds to the bend information (S60: no), or in those cases where the difference from envelope level that has been detected the previous time in the processing of S64 is less than a specified threshold value (S64: no), since the bend down value that is stored in the RAM 54 is initialized to "0" (S70) and a determination has been made that there has not been a finger releasing and a bend down, the bend information that corresponds to the value of the pitch that has been currently detected is transmitted to the tone generator, the bend information that has been transmitted is stored in the ring buffer B (S37), and the interrupt processing ends.

Accordingly, in those cases where the pitch that has been detected has dropped because of a trill performance or a vibrato performance or because the tremolo arm has been operated and the like, the pitch of the tone generator is also changed to track the pitch that has been detected.

In the first preferred embodiment described above, whether or not the pitch that has been currently detected has dropped within a specified range from the pitch of the previous time is detected; and, in those cases where the pitch has dropped within the specified range, a determination was made as to whether or not there is a finger releasing and bend down based on the envelope level; but in the case of a trill performance or a vibrato performance and the like, there are instances of pitch and envelope behavior that is close to that of the case of finger releasing. In particular, in the case of a loose pulling off, the behavior of the pitch and the envelope level resembles that of a finger releasing. Because of this there is a possibility that a trill performance or a vibrato performance will be erroneously detected as a finger releasing.

Therefore, in a second preferred embodiment that is explained next, a determination is made as to whether or not the pitch that has been currently detected has risen more than a specified range above the pitch that has been detected the previous time and in those cases where the pitch has risen above the specified range, it is concluded that a vibrato performance or a bend performance has been carried out and even in those cases where the pitch has dropped after that, it is set up such that the pitch that has been detected is tracked.

In addition, in a case in which the pitch has dropped a half tone that is a case where the pitch has not risen above a specified range and a determination has been made that there is a finger releasing, it is set up such that the instruction of a note height that corresponds to the pitch that has been detected is not carried out during a specified period and, also, after the specified period has passed, in the case of a trill performance and the like where it has been set up so that the determination of a finger releasing is not made and that is a case where the initial pitch has been dropped, it is set up so that a determination that there is a finger releasing is made and the pitch of the musical tone that is generated by the tone generator is not dropped but after a specified period, the pitch tracks in a dropping direction and there are virtually no problems from the standpoint of the performance.

Figure 7:
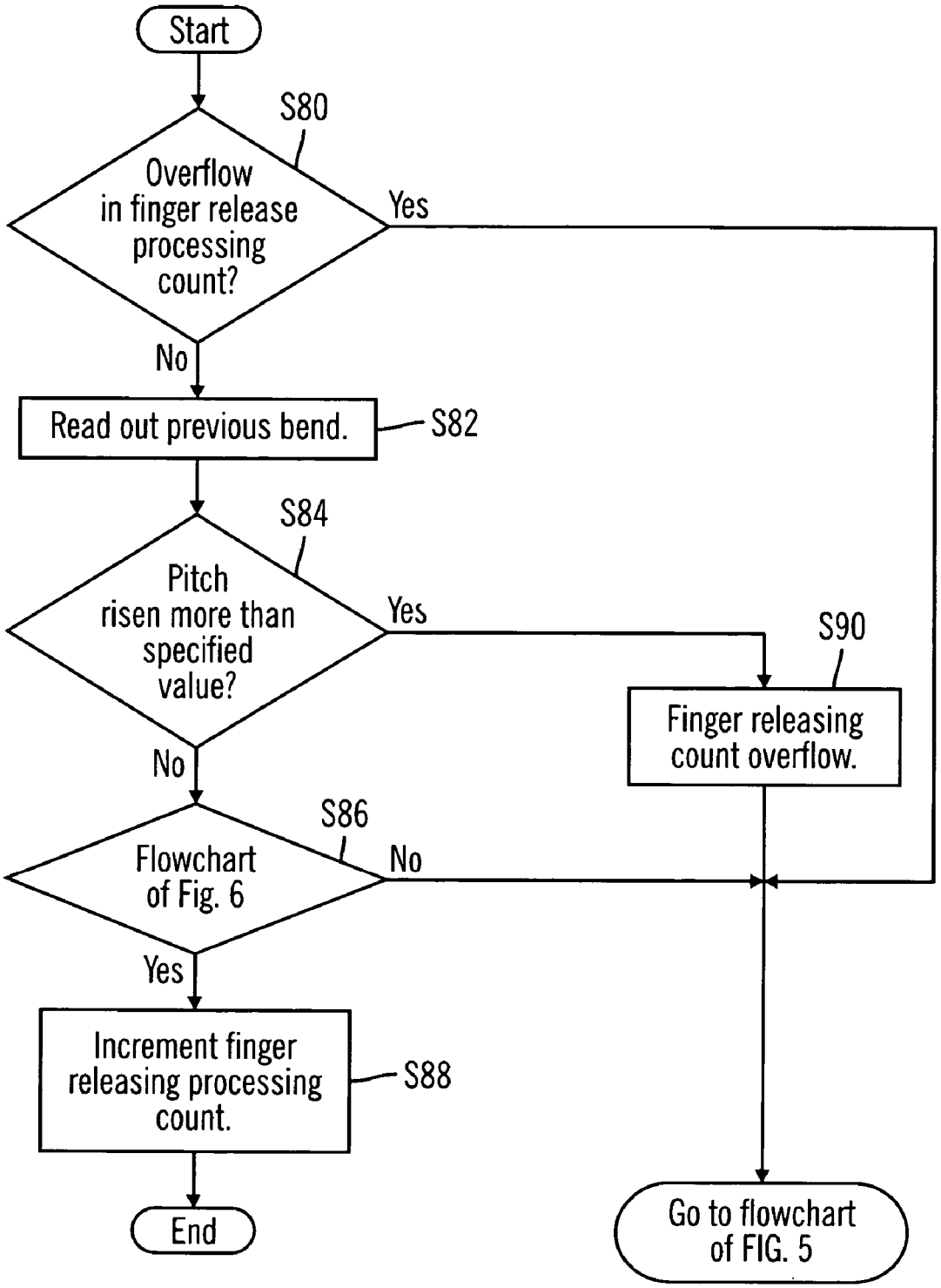
FIG. 7 is a flowchart that shows the processing of a second preferred embodiment.

FIG. 7 is a flowchart that shows the processing described above. First, a determination is made as to whether or not there is an overflow in the finger releasing processing count (S80). In those cases where a determination has been made that there is an overflow in the finger releasing processing count (S80: yes), the determination is that it is not a bend down due to the finger releasing and the routine advances to S36 of the flowchart that is shown in FIG. 5.

In those cases where, in the determination processing of S80, a determination has been made that there is no overflow in the finger releasing processing count (S80: no), the bend value that has been transmitted from the ring buffer B by the processing of S37 the previous time is read out (S82) and a determination is made as to whether the pitch that has been currently detected has risen more than a specified value above the pitch that corresponds to the bend value that has been transmitted the previous time (S84). This specified value is, for example, 50 cents. In those cases where a determination has been made that there has been a rise above a specified value (S84: yes), the finger releasing count is made to overflow (S90). The meaning of "made to overflow" here is that the counter is configured by specified bits and when the most significant bit is set to "1," this is considered to be an overflow. "Made to overflow" thus means to set the most significant bit to "1."

In those cases where, in the processing of S84, a determination has been made that the pitch that has been currently detected has not risen a specified value above the pitch that corresponds to the bend value that has been transmitted the previous time (S84: no), it is concluded that there has been a finger releasing and the routine advances to the processing of S50 of the flowchart that is shown in FIG. 6 (S86). The processing of S86 includes that of the flowchart that is depicted in FIG. 6 and "yes" in the branching of S86 corresponds to the "finger releasing and bend down," which is an exit of the flowchart that is depicted in FIG. 6, while the "no" in the branching of S86 corresponds to the "not a finger releasing and bend down," which is an exit of the flowchart that is depicted in FIG. 6.

In those cases where a determination has been made by the processing of the flowchart of FIG. 6 that there is finger releasing processing and bend down (S86: yes), the finger releasing processing count is incremented and the processing ends. In those cases where, in the processing of the flowchart of FIG. 6, a determination has been made that there is no finger releasing and bend down (S86: no), the flowchart of FIG. 7 ends and the routine advances to the processing of S36 of the flowchart of FIG. 5.

Accordingly, in those cases where the pitch that has been currently detected has risen above a specified value, a determination is not made that there is a finger releasing after that. In addition, in those cases where the pitch that has been currently detected has not risen above a specified value, the determination is made that there is a finger releasing but after the determination that there is a finger releasing is made and a specified period has passed, the determination that there is a finger releasing is not made.

As has been explained above using the preferred embodiments, in those cases where the pitch drops roughly a half tone under conditions in which the envelope level is comparatively great and the envelope level is lower than a specified value or has rapidly attenuated, in accordance with the flowchart that is depicted in FIG. 6, the pitch is controlled so as to not drop; and in those cases where the envelope level is further attenuated and a determination has been made in the processing of S24 of the flowchart that is depicted in FIG. 5 that there has been a drop of roughly a half tone from the pitch of a specified time earlier, the pitch is modified to the pitch of the musical scale that is close to the pitch of the specified time earlier. In this case, since the pitch immediately before when the pitch drop began is maintained and the pitch of the final scale is quantized, the fluctuations in the pitch are held to a minimum.

On the other hand, in those cases where despite the fact that there has been a finger releasing under conditions in which the envelope level is comparatively great, a determination has not been made that there is a finger releasing, at the stage in which the pitch is dropped slightly and the envelope level has attenuated, a determination is made by the processing of S24 of the flowchart that is depicted in FIG. 5 that there is a finger releasing and a pitch based on the musical scale that is close to the pitch at a specified time earlier is returned to.

An example of a sound generation start instruction means is shown at S14 and S40 of the flowchart that is depicted in FIG. 5, an example of a sound generation termination instruction means is shown at S28 in FIG. 5, and an example of a note height instruction means is shown at S26 and S36 in FIG. 5.

An explanation was given above of the present invention based on preferred embodiments, however, the present invention is in no way limited to the preferred embodiments described above and the fact that various modifications and changes are possible that do not deviate from and are within the scope of the essentials of the present invention can be easily surmised.

For example, in the processing of S26 of the flowchart shown in FIG. 5 in the preferred embodiments described above, it has been set up such that a pitch that has been detected earlier is quantized to the note height of a scale that is close to that pitch and the bend information that corresponds to the note height that has been quantized is transmitted, however, it may also be done with the bend information that corresponds to the pitch that has been detected earlier transmitted without quantization.

In addition, it has been set up so that the bend information that has been transmitted is stored in the ring buffer B, however, it may also be set up so that the pitch that corresponds to the bend information or the pitch that has been detected by the pitch detection means and defined is stored.

In addition, it has been set up such that in the processing of S58 and S60 of the flowchart that is depicted in FIG. 6, a determination is made as to whether or not the current pitch has dropped roughly a half tone from the bend value that has been stored in the ring buffer and that has been transmitted the previous time, however, this is a simple method in order to restrain the processing load here and in those cases where the capability of the CPU is satisfactorily high, it may also be set up so that a comparison is made with the bend value that is stored in the ring buffer within a specified period and the determination made. If it is done this way, it can be expected that the finger releasing detection accuracy will be further improved.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. An electronic stringed instrument comprising:

pitch detection means in which a pitch of a string vibration is detected for each of a plurality of specified periods of time;

level detection means in which an envelope level of the string vibration is detected;

sound generation start instruction means in which the start of the generation of a musical tone is instructed based on the pitch that has been detected by the pitch detection means and the envelope level that has been detected by the level detection means;

storage means in which the pitches that have been detected by the pitch detection means are stored successively;

sound generation termination instruction means in which the termination of the musical tone, the start of the generation of which has been instructed by the sound generation start instruction means, is instructed based on the envelope level that has been detected by the level detection means; and note height instruction means in which in those cases where when the sound generation termination instruction means instructs the termination of the sound generation, the pitch that has been detected by the pitch detection means is roughly a halftone lower than the pitch that has been detected at a specified time earlier and stored in the storage means, instructs the note height based on the pitch that has been detected at the specified time earlier that is stored in the storage means.

2. The electronic musical instrument of claim 1, wherein the note height instruction means is one in which the note height is instructed in a scale that is close to the pitch that has been detected prior at the specified time earlier and stored in the storage means.

3. An electronic stringed instrument, comprising:

pitch detection means in which a pitch of string vibrations is detected for each a plurality of specified periods of time;

level detection means in which an envelope level of the string vibrations is detected for each specified period of time;

pitch storage means in which a pitch that has been detected in a previous time period by the pitch detection means is stored;

level storage means in which an envelope level that has been detected in the previous time period by the level detection means is stored; and note height instruction means, wherein:

(1) in those cases where a pitch that has been currently detected by the pitch detection means is about a halftone lower than the pitch that has been stored in the pitch storage means and, moreover, an envelope level that has been currently detected by the level detection means is lower than a first specified value, or (2) in those cases where the pitch that has been currently detected by the pitch detection means is about a halftone lower than the pitch that has been stored in the pitch storage means and, moreover, the difference between the envelope level that has been currently detected by the level detection means and the envelope level that has been stored in the level storage means is greater than a second specified value, the instruction of a note height that corresponds to the pitch that has been currently detected by the pitch detection means is not carried out; and in those cases where the pitch that has currently been detected by the pitch detection means is different from the pitch that has been stored in the pitch storage means and, moreover, cases other than (1) or (2), the instruction of a note height that corresponds to the pitch that has been currently detected by the pitch detection means is carried out.

4. The electronic stringed instrument of claim 3, wherein the note height instruction means is one in which, in those cases where the instruction of a note height that corresponds to the currently detected pitch is not instructed and in those cases where, at or after a specified period, the pitch that has been detected by the pitch detection means is roughly the same as the pitch that has been currently detected, the instruction of a note height that corresponds to the pitch that has been detected by the pitch detection means is not carried out.

5. An electronic stringed instrument, comprising:

pitch detection means in which a pitch of string vibrations is detected for each a plurality of specified periods of time;

level detection means in which an envelope level of the string vibrations is detected for each specified period of time;

pitch storage means in which a pitch that has been detected in a previous time period by the pitch detection means is stored;

level storage means in which an envelope level that has been detected in the previous time period by the level detection means is stored; and note height instruction means, wherein:

in those cases where a pitch that has been currently detected by the pitch detection means has not risen to a specified value above the pitch that has been stored in the pitch storage means, and either (1) the pitch that has been currently detected by the pitch detection means is about a half tone lower than the pitch that has been stored in the pitch storage means and, moreover, an envelope level that has been currently detected by the level detection means is lower than a first specified value, or (2) the pitch that has been currently detected by the pitch detection means is about a half tone lower than the pitch that has been stored in the pitch storage means and, moreover, the difference between the envelope level that has been currently detected by the level detection means and the envelope level that has been stored in the level storage means is greater than a second specified value, the instruction of a note height that corresponds to the pitch that has been currently detected by the pitch detection means is not carried out;

in those cases where the pitch that has been currently detected by the pitch detection means has not risen to the specified value above the pitch that has been stored in the pitch storage means and the pitch that has been currently detected by the pitch detection means is different from the pitch that has been stored in the pitch storage means and, moreover, cases other than (1) or (2), the instruction of a note height that corresponds to the pitch that has been currently detected by the pitch detection means is carried out; and in those cases where the pitch that has been currently detected by the pitch detection means has risen to the specified value above the pitch that has been stored in the pitch storage means, a note height instruction for a note height that corresponds to the pitch that has been detected at that time or later is carried out.

6. The electronic stringed instrument of claim 5, wherein the note height means is one in which, in those cases where the period in which the instruction of a note height that corresponds to the pitch that has been currently detected has exceeded a specified period, the instruction of a note height that corresponds to the pitch that has been currently detected by the pitch detection means is carried out at that time or later.

7. An electronic stringed instrument having strings that are operable to vibrate, the electronic stringed instrument comprising:

a pitch detector for detecting a pitch of string vibrations;

a level detector for detecting an envelope level of string vibrations;

a storage element; and a sound controller for causing a tone generator to generate musical tones, and for controlling note heights of the musical tones;

wherein the pitch detector detects a first pitch from string vibrations during a first time period;

wherein the sound controller causes the tone generator to generate a musical tone with a note height based on the first pitch;

wherein the first pitch is stored in the storage element;

wherein the pitch detector detects a second pitch from string vibrations during a second time period after the first time period, and the level detector detects a second envelope level from string vibrations during the second time period; and wherein if the second pitch is approximately a halftone lower than the first pitch and the second envelope level is below a threshold value, the sound controller controls the note height of the musical tone based on the first pitch.

8. The electronic stringed instrument of claim 7, wherein if the second pitch is approximately a half tone lower than the first pitch and the second envelope level is below the threshold value, the sound controller controls the note height of the musical tone to be in a scale that is close to the first pitch.

9. The electronic stringed instrument of claim 7, wherein if the second pitch is approximately a half tone lower than the first pitch and the second envelope level is below the threshold value, the sound controller controls the note height of the musical tone based on the first pitch so that the note height does not drop.

10. The electronic stringed instrument of claim 7, wherein the level detector detects a first envelope level from string vibrations during the first time period;

wherein the first envelope level is stored in the storage element;

wherein if the second pitch is approximately a half tone lower than the first pitch and either the second envelope level is below the threshold value or a difference between the first envelope level and the second envelope level is greater than a specified value, the sound controller controls the note height of the musical tone based on the first pitch.

11. The electronic stringed instrument of claim 7, wherein if the second pitch is approximately a half tone lower than the first pitch and the second envelope level is below the threshold value, the sound controller controls the tone generator to terminate the generation of the musical tone by attenuating the musical tone over a specified time interval.

12. The electronic stringed instrument of claim 7, wherein the pitch detector detects a third pitch from string vibrations during a third time period after the second time period, and the level detector detects a third envelope level from string vibrations during the third time period;

wherein if the second pitch is greater than the first pitch by a specified value, then if the third pitch is approximately a half tone lower than the first pitch and the third envelope level is below a second threshold value, the sound controller controls the note height of the musical tone based on the third pitch; and wherein if the second pitch is not greater than the first pitch by a specified value, then if the third pitch is approximately a half tone lower than the first pitch and the third envelope level is below the second threshold value, the sound controller controls the note height of the musical tone based on the first pitch.

13. The electronic stringed instrument of claim 7, wherein the pitch detector and the level detector are realized by means of a DSP.

14. The electronic stringed instrument of claim 7, wherein the storage element comprises a RAM.

15. An electronic system for processing signals from a stringed instrument, the stringed instrument having strings operable to vibrate, the electronic system comprising:

a pitch detector for detecting a pitch of string vibrations;

a level detector for detecting an envelope level of string vibrations;

a storage element; and a sound controller for causing a tone generator to generate musical tones, and for controlling note heights of the musical tones;

wherein the pitch detector detects a first pitch from string vibrations during a first time period;

wherein the sound controller causes the tone generator to generate a musical tone with a note height based on the first pitch;

wherein the first pitch is stored in the storage element;

wherein the pitch detector detects a second pitch from string vibrations during a second time period after the first time period, and the level detector detects a second envelope level from string vibrations during the second time period; and wherein if the second pitch is approximately a half tone lower than the first pitch and the second envelope level is below a threshold value, the sound controller controls the note height of the musical tone based on the first pitch.

16. The electronic system of claim 15, wherein if the second pitch is approximately a half tone lower than the first pitch and the second envelope level is below the threshold value, the sound controller controls the note height of the musical tone to be in a scale that is close to the first pitch.

17. The electronic system of claim 15, wherein if the second pitch is approximately a half tone lower than the first pitch and the second envelope level is below the threshold value, the sound controller controls the note height of the musical tone based on the first pitch so that the note height does not drop.

18. The electronic system of claim 15, wherein the level detector detects a first envelope level from string vibrations during the first time period;

wherein the first envelope level is stored in the storage element;

wherein if the second pitch is approximately a half tone lower than the first pitch and either the second envelope level is below the threshold value or a difference between the first envelope level and the second envelope level is greater than a specified value, the sound controller controls the note height of the musical tone based on the first pitch.

19. The electronic system of claim 15, wherein if the second pitch is approximately a half tone lower than the first pitch and the second envelope level is below the threshold value, the sound controller controls the tone generator to terminate the generation of the musical tone by attenuating the musical tone over a specified time interval.

20. The electronic system of claim 15, wherein the pitch detector detects a third pitch from string vibrations during a third time period after the second time period, and the level detector detects a third envelope level from string vibrations during the third time period;

wherein if the second pitch is greater than the first pitch by a specified value, then if the third pitch is approximately a half tone lower than the first pitch and the third envelope level is below a second threshold value, the sound controller controls the note height of the musical tone based on the third pitch; and wherein if the second pitch is not greater than the first pitch by a specified value, then if the third pitch is approximately a half tone lower than the first pitch and the third envelope level is below the second threshold value, the sound controller controls the note height of the musical tone based on the first pitch.

21. The electronic system of claim 15, wherein the pitch detector and the level detector are realized by means of a DSP.

22. The electronic system of claim 15, wherein the storage element comprises a RAM.

23. A method for processing signals from a stringed instrument, the stringed instrument having a fret and strings operable to vibrate, the method comprising the steps of:

detecting a first pitch of string vibrations of a string during a first time interval when the string is pressed on the fret by a finger of a user;

causing a tone generator to generate a musical tone with a note height based on the first pitch;

detecting a second pitch and a second envelope level of string vibrations of the string during a second time interval after the first time interval;

determining from the first pitch, the second pitch, and the second envelope level whether or not the finger of the user has been released from the fret; and controlling the note height of the musical tone so that there is approximately no change in note height if the finger of the user has been released from the fret;

wherein the step of determining from the first pitch, the second pitch, and the second envelope level whether or not the finger of the user has been released from the fret, comprises the step of determining that the finger of the user has been released from the fret if the second pitch is approximately a half tone lower than the first pitch and the second envelope level is below a threshold value.

24. A method for processing signals from a stringed instrument, the stringed instrument having a fret and strings operable to vibrate, the method comprising the steps of:

detecting a first pitch of string vibrations of a string during a first time interval when the string is pressed on the fret by a finger of a user;

causing a tone generator to generate a musical tone with a note height based on the first pitch;

detecting a second pitch and a second envelope level of string vibrations of the string during a second time interval after the first time interval;

determining from the first pitch, the second pitch, and the second envelope level whether or not the finger of the user has been released from the fret; and controlling the note height of the musical tone so that there is approximately no change in note height if the finger of the user has been released from the fret;

wherein the step of detecting a first pitch of string vibrations of a string during a first time interval when the string is pressed on the fret by a finger of a user, comprises the step of:

detecting a first pitch and a first envelope level of string vibrations of a string during a first time interval when the string is pressed on the fret by a finger of a user; and wherein the step of determining from the first pitch, the second pitch, and the second envelope level whether or not the finger of the user has been released from the fret, comprises the step of:

determining that the finger of the user has been released from the fret if the second pitch is approximately a half tone lower than the first pitch and either the second envelope level is below a threshold value or the difference between the first envelope level and the second envelope level is greater than a specified value.

25. A method for processing signals from a stringed instrument, the method comprising the steps of:

detecting a first pitch of string vibrations during a first time period;

controlling a tone generator to generate a musical tone with a note height based on the first pitch;

detecting a second pitch of string vibrations during a second time period after the first time period;

detecting a third pitch and a third envelope level of string vibrations during a third time period after the second time period;

controlling the tone generator to not change the note height of the musical tone if the difference between the second pitch and the first pitch is less than a first threshold value, and the third pitch is approximately a half tone lower than the first pitch, and the third envelope level is lower than a second threshold value; and controlling the tone generator to change the note height of the musical tone to a second note height based on the third pitch if the difference between the second pitch and the first pitch is greater than the first threshold value, even if the third pitch is approximately a half tone lower than the first pitch and the third envelope level is lower than the second threshold value.

26. An electronic stringed instrument having strings that are operable to vibrate, the electronic stringed instrument comprising:

a pitch detector for detecting a pitch of string vibrations;

a level detector for detecting an envelope level of string vibrations;

a storage element; and a sound controller for causing a tone generator to generate musical tones, and for controlling note heights of the musical tones;

wherein the pitch detector detects a first pitch from string vibrations during a first time period and the level detector detects a first envelope level from string vibrations during the first time period;

wherein the sound controller causes the tone generator to generate a musical tone with a note height based on the first pitch;

wherein the first pitch and the first envelope level are stored in the storage element;

wherein the pitch detector detects a second pitch from string vibrations during a second time period after the first time period, and the level detector detects a second envelope level from string vibrations during the second time period; and wherein if the second pitch is approximately a half tone lower than the first pitch and a difference between the first envelope level and the second envelope level is greater than a specified value, the sound controller controls the note height of the musical tone based on the first pitch.

* * * * *